United States Patent [19]

Asahi et al.

[11] Patent Number: 4,780,579

[45] Date of Patent: Oct. 25, 1988

[54] CIRCUIT BREAKER

[75] Inventors: Nobuo Asahi; Jun Oyama, both of Kanagawa, Japan

[73] Assignee: Fuji Electric Co., Ltd., Kanagawa, Japan

[21] Appl. No.: 168,399

[22] Filed: Mar. 15, 1988

[30] Foreign Application Priority Data

Apr. 21, 1987 [JP] Japan ..... 62-60213[U]

[51] Int. Cl.[4] ..... H01H 33/04

[52] U.S. Cl. ..... 200/144 R; 200/144 C

[58] Field of Search ..... 200/144 R, 144 C

[56] References Cited

U.S. PATENT DOCUMENTS

| | | | |
|---|---|---|---|
| 4,086,460 | 4/1978 | Gillette | 200/144 R |
| 4,459,445 | 7/1984 | Hisatsune et al. | 200/144 R |
| 4,581,511 | 4/1986 | Leone | 200/144 R |

*Primary Examiner*—Robert S. Macon

*Attorney, Agent, or Firm*—Finnegan, Henderson, Farabow, Garrett and Dunner

[57] ABSTRACT

A circuit breaker includes an insulating case, a fixed contact, and an insulating member covering the top surface of the fixed contact. A first end of the insulating member is received in a locking slot of the case and a second end includes an opening through which a raised portion of the fixed contact extends. A contact point is provided on the raised portion of the fixed contact.

7 Claims, 2 Drawing Sheets

CIRCUIT BREAKER

FIELD OF THE INVENTION

This device relates to a circuit breaker of mainly small capacity and havinq an arc-extinguishing space.

BACKGROUND OF THE INVENTION

FIGS. 4 and 5 depict two known circuit breakers of the above-mentioned type. Referring first to FIG. 4, inside an insulating case 1 that is divided into two portions, there are provided a contact apparatus 20 which constitutes a portion of cable way, a switching mechanism 30 for opening/closing the contact apparatus 20, an overcurrent trip apparatus 40 connected in series to the contact appartus 20 for disconnecting the contact apparatus 20 via the switching mechanism 30 when the current of the cable way becomes excessively high.

The insulating case is generally made of phenol aldehyde resin. To each of the facing portions of the insulating case 1, there are formed an arc-extinguishing space 1*a* above the contact parting area of a fixed contact 11 and a movable contact 12 (right side in the figure), which constitute the contact apparatus 20. To the upper portion of the arc-extinguishing space 1*a* there is provided an air exit 1*b* that is covered with a mesh plate 2 in order to prevent an invasion of foreign materials. To the back face side of the arc-extinguishing space 1*a* (lower side in the figure) there is provided a guide slot 1*c* in which the fixed contact 11 is to be fixed. On the facing inner walls of the arc-extinguishing space 1*a*, respectively, is formed an insulating coat 3 of high arc resistance epoxy resin or the like in order to prevent deterioration of the insulation between the contacts due to carbonization of the surfaces by arcing generated upon opening of the contact apparatus 20. Referring now to the circuit breaker of FIG. 5, the difference compared with the above-mentioned circuit breaker is that as means for preventing the deterioration of insulation between contacts by arcing generated upon circuit-breaking, there is provided an insulating collar 5 that is formed by folding fiber or the like into a gate shape and fitting the fiber from around the arc-extinguishing space 1*a* by means of reinforcing metal 4.

In such conventional circuit breakers, the insulating coat 3 must be applied manually which is inefficient and requires considerable waiting time between coating and desiccation. The insulating collar 5 needs to be fixed by the reinforcing metal 4 in order to avoid deformation and displacement thereof, which is costly.

OBJECTS AND SUMMARY OF THE INVENTION

A object of this device is to provide a circuit breaker having a simple structure that is easy to assemble.

Another object of the present invention is a circuit breaker in which the deterioration of insulation between the contacts is prevented.

In order to accomplish the above and other objects, according to the present device, there IS provided a circuit breaker comprising an insulating case including an air exit and a locking slot, a fixed contact provided in the case and including a contact point, and an insulating member having a first end for covering the fixed contact, the first end having an opening over the contact point, a second end engaged in the locking slot of the insulating case, and a plurality of openings at a position corresponding to the air exit.

BRIEF DESCRIPTION OF THE DRAWINGS

The manner by which the above objects and other objects, features, and advantages of the present invention are attained will be fully apparent from the following description considered in view of the drawings, wherein.

DETAILED DESCRIPTION

In the circuit breaker of the present invention, the surface of a fixed contact except for a fixed contact point is covered with an insulating plate, and a mesh-like holes are formed in the insulating plate so as to close the air exit against the invasion by foreign material. Also, installation is accomplished merely by engaging the insulating plate with a seating base that is raised up by cutting a fixed contact, and engaging the insulating plate in a locking slot formed within the insulating case.

Figure 1:
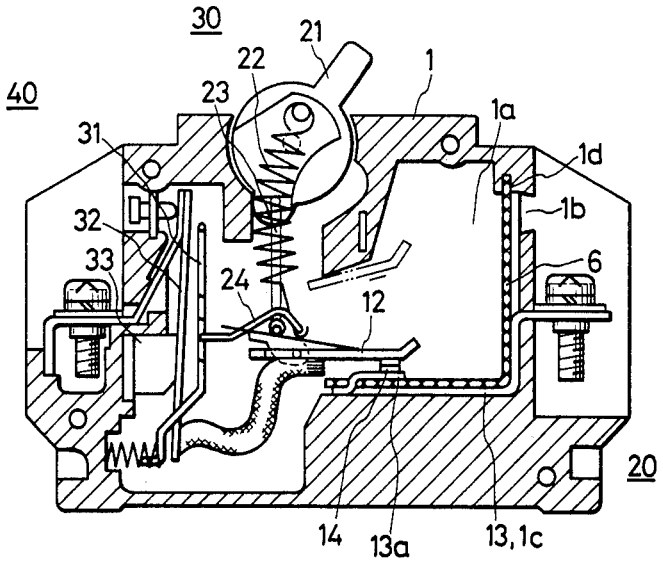
FIG. 1 is a longitudinal sectional view of the circuit breaker of the present invention.
Figure 2:
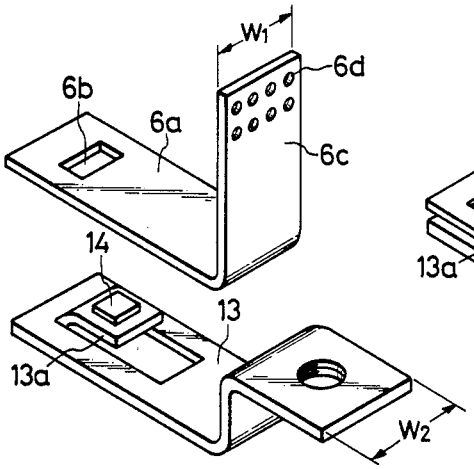
FIG. 2 is a perspective view of a disassembly of a portion of FIG. 1.
Figure 3:
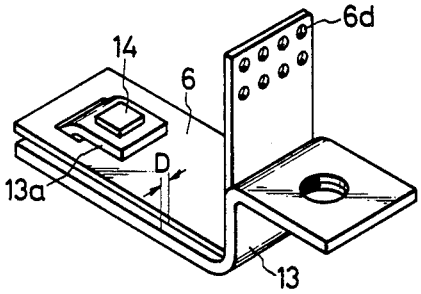
FIG. 3 is a perspective view of unified parts of FIG. 2.
Figure 4:
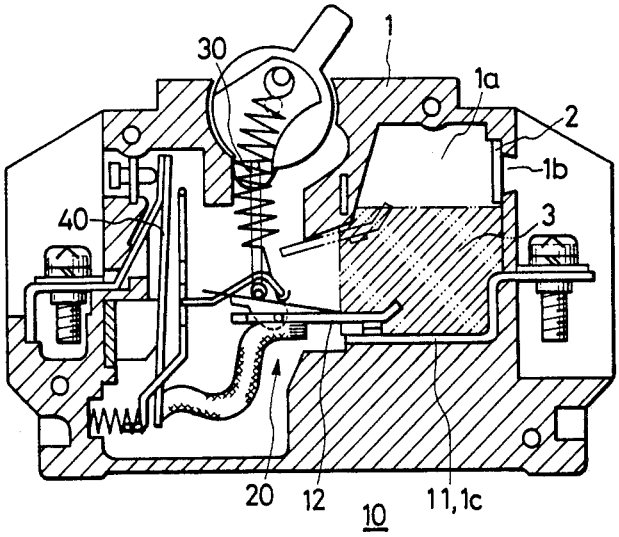
FIG. 4 is a longitudinal sectional view of a conventional, small capacity circuit breaker.
Figure 5:
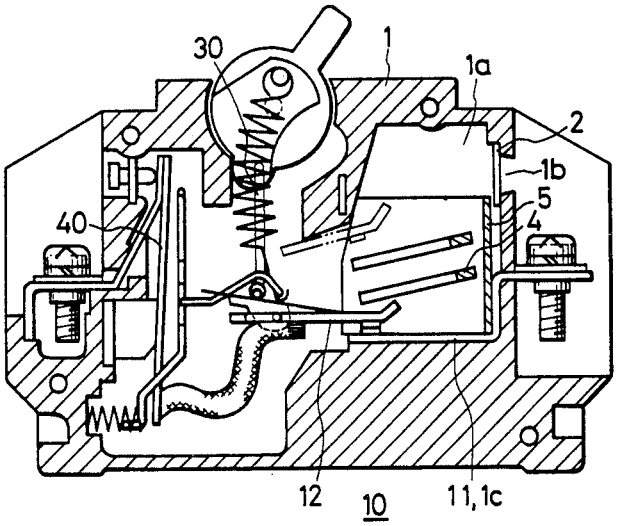
FIG. 5 is a longitudinal sectional view of another conventional small capacity circuit breaker.

FIGS. 1 to 3 are drawings, showing an embodiment of the circuit breaker of the present invention. In those figures, the same reference symbols are used to designate like parts as described with respect to the conventional devices shown in FIGS. 4 and 5.

The circuit breaker of the present invention departs from conventional breakers in that the deterioration of insulation between the fixed contact 13 and the movable contact 12 upon circuit-breaking can be prevented by covering the fixed contact 13 with the insulating plate 6 except in the area of the fixed contact point 14. The insulating plate 6 also serves to prevent an invasion of foreign matters through the air exit 1*a*, and reliable assembly is obtained merely by insertion. The fixed contact 13 is cut and bent to raise up a seat 13*a* on which the fixed contact point 14 is adhered by soldering or the like. Within the insulating case 1 there is provided a locking slot 1*d* for the end portion of the insulating plate 6 at the front side of an air exit 1*b* (upper side in FIG. 1). On the other hand, the insulating plate 6 is made of a fiber belt or the like, having a width $W_1$ that is equal to width $W_2$ of the fixed contact 13, and is folded into an L-shape. In a first leg 6*a*, there is provided a rectangular opening 6*b* through which the seating base 13*a* can extend and in the other leg 6*c* there are formed mesh-like holes 6*d* at a portion that faces to the air exit 1*a*. Installation of the insulating plate 6 within the insulating case 1 is finished merely by engaging the rectangular opening 6*b* of the leg 6*a* with the seating base 13*a* of the fixed contact 13, and the end portion of the other leg 6*c* within the locking slot of the insulating case 1.

Opening and closing the circuit breaker is performed by swinging an operation handle 21, which constitutes an opening-closing mechanism 30. The opening operation from the closed state shown in FIG. 1 is conducted as follows. As the line of action of an opening-closing spring 22 exceeds the dead center of a link pin 23 by moving the operation handle 21 counterclockwise, the circuit-breaking spring 22 undergoes a backward bending. This disengages a link holder 24 from a movable iron core 31 of an overcurrent trip apparatus 40 so that the movable contact 12 supported by the link holder 24 will undergo an opening movement. The closing operation is conducted in reverse. When an excess current is supplied to the breaker, the movable iron core 31 and the link holder 24 will be disengaged from each other by curving of a bimetal element 32 due to heat, or by the fixed iron core 33 of the movable iron core 31, whereby the link holder 24 will be moved by the opening-closing spring 22 to separate the movable contact 12 from the fixed contact 13.

According to this device, since the entire surface of the fixed contact except the fixed contact point is covered with the insulating plate, the inner walls of the arc-extinguishing space are protected from arcing and the insulation capacity between the contacts is secured. The insulating plate is extended to prevent the invasion of foreign matters through the air exit and assembly is performed merely by inserting, making it possible to provide a less expensive circuit breaker.

What is claimed is:

1. A circuit breaker comprising:

an insulating case including an air exit and a locking slot;

a fixed contact provided in said case and including a contact point; and an insulating member having a first end for covering said fixed contact, said first end having an opening over said contact point, a second end engaged in said locking slot of said insulating case, and a plurality of openings at a position corresponding to said air exit.

2. A circuit breaker according to claim 1, wherein said fixed contact includes an integral raised portion extending through said opening in said insulating member and supporting said contact point.

3. A circuit breaker according to claim 1, wherein said fixed contact includes a substantially L-shaped portion and said insulating member is substantially L-shaped and covers said L-shaped portion of said fixed contact.

4. A circuit breaker according to claim 1, wherein said insulating case includes a guide slot and said fixed contact includes an end extending through said guide slot.

5. A circuit breaker according to claim 1, wherein said fixed contact and said insulating member are substantially equal in width.

6. A circuit breaker according to claim 1, wherein said insulating member is made from a plate of insulative fibers.

7. A circuit breaker comprising:

an insulating case including a guide slot for receiving a fixed contact, an air exit, and a locking slot;

a fixed contact provided in said guide slot and including a seating base having a contact point; and an insulating member having a first end for covering said fixed contact, said first end having an opening over said contact point, a second end engaged in said locking slot of said insulating case, and a plurality of openings at a position corresponding to said air exit.

* * * * *